US006226804B1

(12) United States Patent
Ballard

(10) Patent No.: US 6,226,804 B1
(45) Date of Patent: May 8, 2001

(54) AUTOMATIC TOILET COVER AND SEAT LIFTING AND LOWERING DEVICE

(76) Inventor: Calvin Ballard, 4066 Center St., Norco, CA (US) 91760

( * ) Notice: Subject to any disclaimer, the term of this patent is extended or adjusted under 35 U.S.C. 154(b) by 0 days.

(21) Appl. No.: 09/667,469

(22) Filed: Sep. 22, 2000

(51) Int. Cl.[7] ..... A47K 13/10
(52) U.S. Cl. ..... 4/246.1
(58) Field of Search ..... 4/246.1–246.5, 4/248

(56) References Cited

U.S. PATENT DOCUMENTS 1,863,682 * 6/1932 Alberts ..... 4/246.3
2,219,044 * 10/1940 Horr ..... 4/246.1
3,781,924 * 1/1974 Davis, Jr. ..... 4/246.2
4,055,864 * 11/1977 Liu et al. ..... 4/246.1
4,766,619 * 8/1988 Takeda ..... 4/246.1
5,280,654 * 1/1994 Wolfer ..... 4/246.1

* cited by examiner

*Primary Examiner*—Charles R. Eloshway
(74) *Attorney, Agent, or Firm*—Goldstein & Canino

(57) ABSTRACT

An automatic toilet cover and seat lifting and lowering device including a motor secured to the cental flange of the toilet. The motor includes a central gear positioned forwardly thereof. A lifting apparatus is coupled with the motor and the toilet seat and toilet cover. The lifting apparatus includes a gear positioned forwardly of and engaged to the central gear of the motor. The gear has a shaft extending laterally therethrough. The shaft has opposed free ends. The opposed free ends each have an elongated arm extending forwardly therefrom. The elongated arms extend within the toilet seat and the toilet cover. An activation switch is disposed adjacent to the toilet. The activation switch is in communication with the motor. The activation switch has a first position for operating the motor in a raising orientation and a second position for operating the motor in a lowering orientation.

2 Claims, 4 Drawing Sheets

AUTOMATIC TOILET COVER AND SEAT LIFTING AND LOWERING DEVICE

BACKGROUND OF THE INVENTION

The present invention relates to an automatic toilet cover and seat lifting and lowering device and more particularly pertains to automatically lifting and lowering a toilet seat and toilet cover without physical assertion.

In order to use a toilet, the movement of certain parts of the toilet is required. Usually, men must raise both the toilet cover and toilet seat in order to use from a standing position. It is generally unsanitary to make hand contact with the cover and seat. Additionally, the raising of the cover and seat requires some bending of the back in order to accomplish sometimes causing undue stress on the back. What is needed is a way to both lift and lower the toilet cover and toilet seat without having to come in contact with these items as well as not having to bend over in order to achieve.

The present invention attempts to solve the abovementioned problem by providing a device that is secured to a toilet that can raise and lower the seat and cover of a toilet simply with the manipulation of a switch.

The use of toilet accessories is known in the prior art. More specifically, toilet accessories heretofore devised and utilized for the purpose of facilitating the sanitary use of toilets are known to consist basically of familiar, expected and obvious structural configurations, notwithstanding the myriad of designs encompassed by the crowded prior art which have been developed for the fulfillment of countless objectives and requirements.

While these devices fulfill their respective, particular objective and requirements, these patents do not describe an automatic toilet cover and seat lifting and lowering device for automatically lifting and lowering a toilet seat and toilet cover without physical assertion.

In this respect, the automatic toilet cover and seat lifting and lowering device according to the present invention substantially departs from the conventional concepts and designs of the prior art, and in doing so provides an apparatus primarily developed for the purpose of automatically lifting and lowering a toilet seat and toilet cover without physical assertion.

Therefore, it can be appreciated that there exists a continuing need for a new and improved automatic toilet cover and seat lifting and lowering device which can be used for automatically lifting and lowering a toilet seat and toilet cover without physical assertion. In this regard, the present invention substantially fulfills this need.

SUMMARY OF THE INVENTION

In the view of the foregoing disadvantages inherent in the known types of toilet accessories now present in the prior art, the present invention provides an improved automatic toilet cover and seat lifting and lowering device. As such, the general purpose of the present invention, which will be described subsequently in greater detail, is to provide a new and improved automatic toilet cover and seat lifting and lowering device which has all the advantages of the prior art and none of the disadvantages.

To attain this, the present invention essentially comprises an electrically powered motor secured to the cental flange of the toilet. The motor is positioned under a protective housing. The motor includes a central gear positioned forwardly thereof. A lifting apparatus is coupled with the motor and the toilet seat and toilet cover. The lifting apparatus includes a gear disposed under the protective housing and positioned forwardly of and engaged to the central gear of the motor. The gear has a shaft extending laterally therethrough. The shaft has opposed free ends. The opposed free ends each have an elongated arm extending forwardly therefrom. The elongated arms extend within the toilet seat and the toilet cover. An activation switch is disposed adjacent to the toilet. The activation switch is in communication with the motor. The activation switch has a first position for operating the motor in a raising orientation and a second position for operating the motor in a lowering orientation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved automatic toilet cover and seat lifting and lowering device which has all the advantages of the prior art toilet accessories and none of the disadvantages.

It is another object of the present invention to provide a new and improved automatic toilet cover and seat lifting and lowering device which may be easily and efficiently manufactured and marketed.

It is a further object of the present invention to provide a new and improved automatic toilet cover and seat lifting and lowering device which is of durable and reliable construction.

An even further object of the present invention is to provide a new and improved automatic toilet cover and seat lifting and lowering device which is susceptible of a low cost of manufacture with regard to both materials and labor, and which accordingly is then susceptible of low prices of sale to the consuming public, thereby making such an automatic toilet cover and seat lifting and lowering device economically available to the buying public.

Even still another object of the present invention is to provide a new and improved automatic toilet cover and seat lifting and lowering device for automatically lifting and lowering a toilet seat and toilet cover without physical assertion.

Lastly, it is an object of the present invention to provide a new and improved automatic toilet cover and seat lifting and lowering device including a motor secured to the cental flange of the toilet. The motor includes a central gear positioned forwardly thereof. A lifting apparatus is coupled with the motor and the toilet seat and toilet cover. The lifting apparatus includes a gear positioned forwardly of and engaged to the central gear of the motor. The gear has a shaft extending laterally therethrough. The shaft has opposed free ends. The opposed free ends each have an elongated arm extending forwardly therefrom. The elongated arms extend within the toilet seat and the toilet cover. An activation switch is disposed adjacent to the toilet. The activation switch is in communication with the motor. The activation switch has a first position for operating the motor in a raising orientation and a second position for operating the motor in a lowering orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
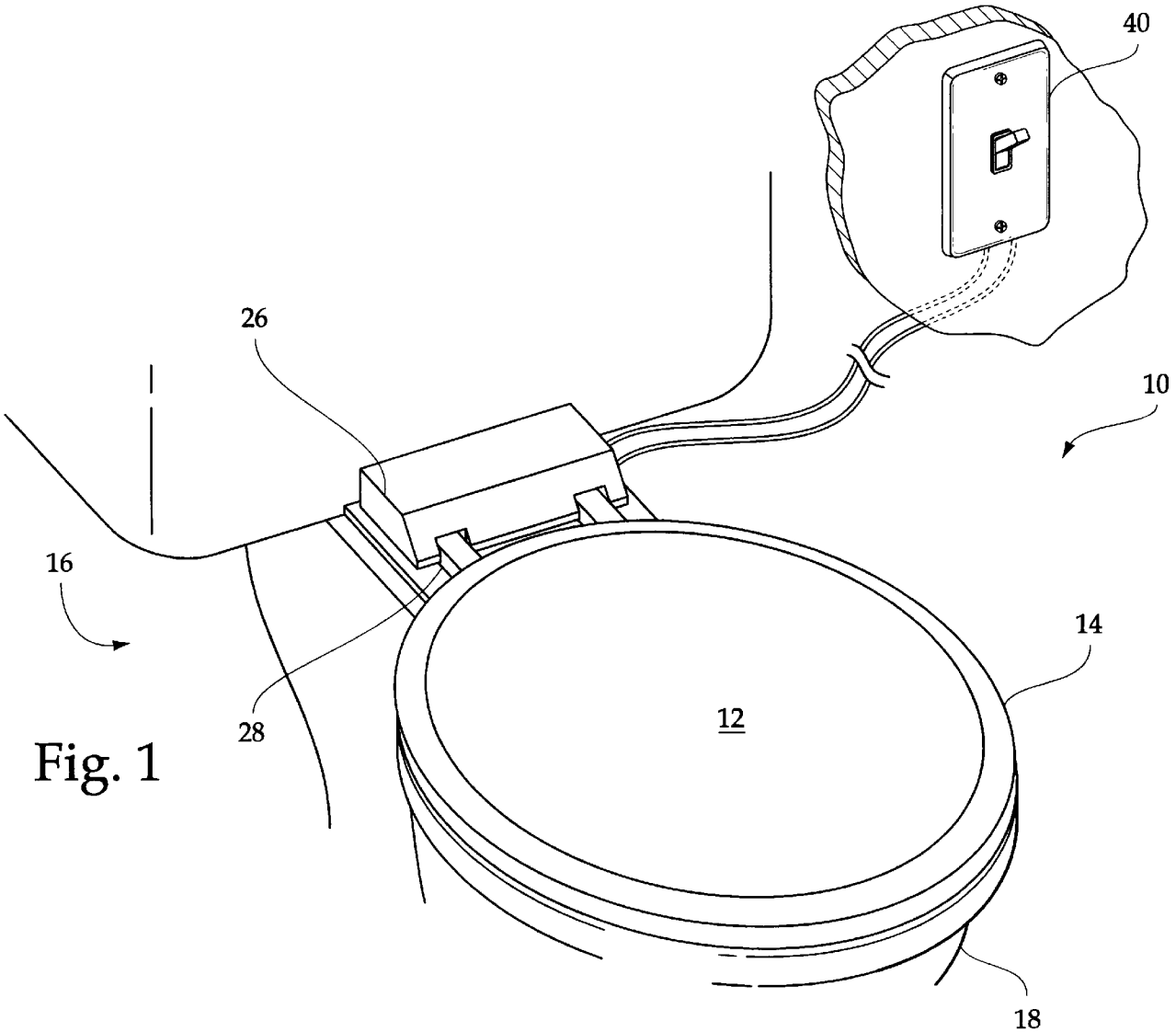
FIG. 1 is a perspective view of the preferred embodiment of the automatic toilet cover and seat lifting and lowering device constructed in accordance with the principles of the present invention.
Figure 2:
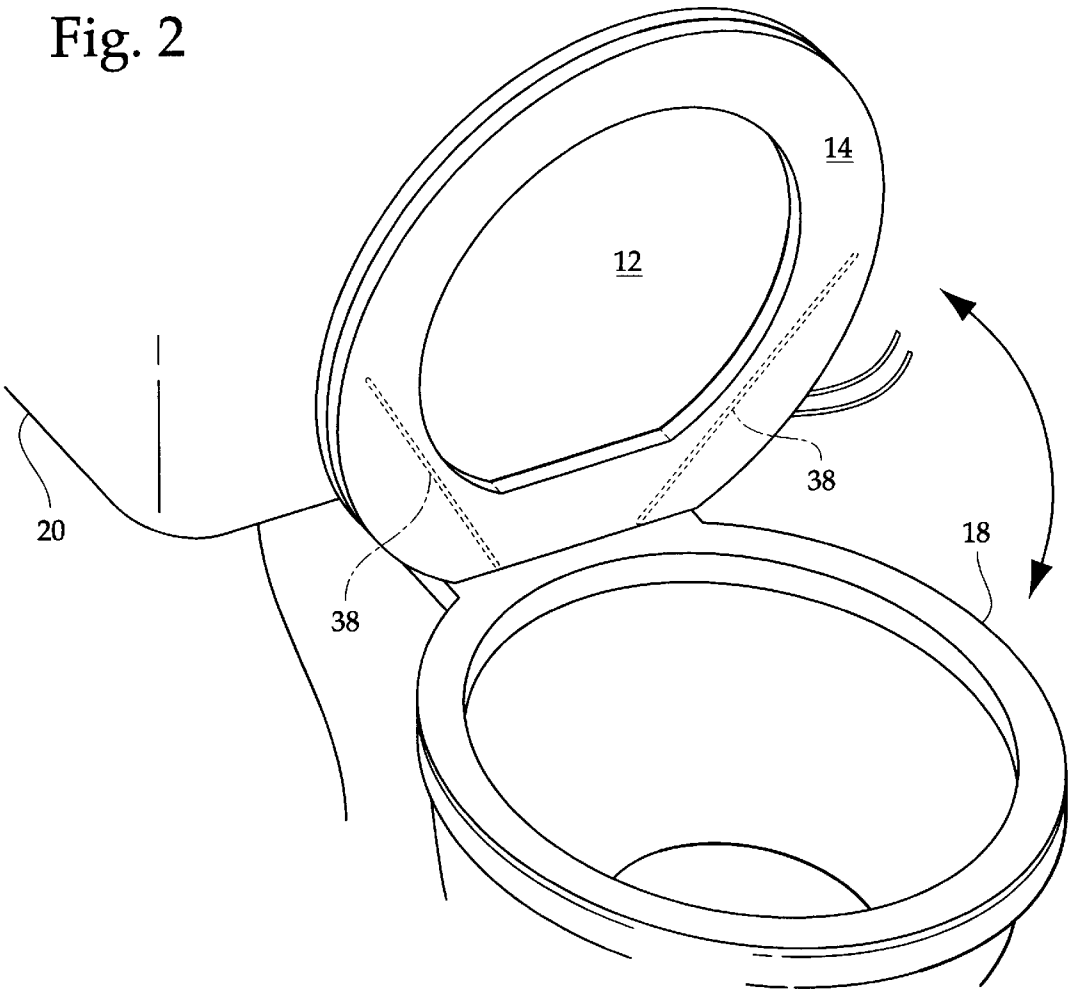
FIG. 2 is a perspective view of the present invention illustrated in use.
Figure 3:
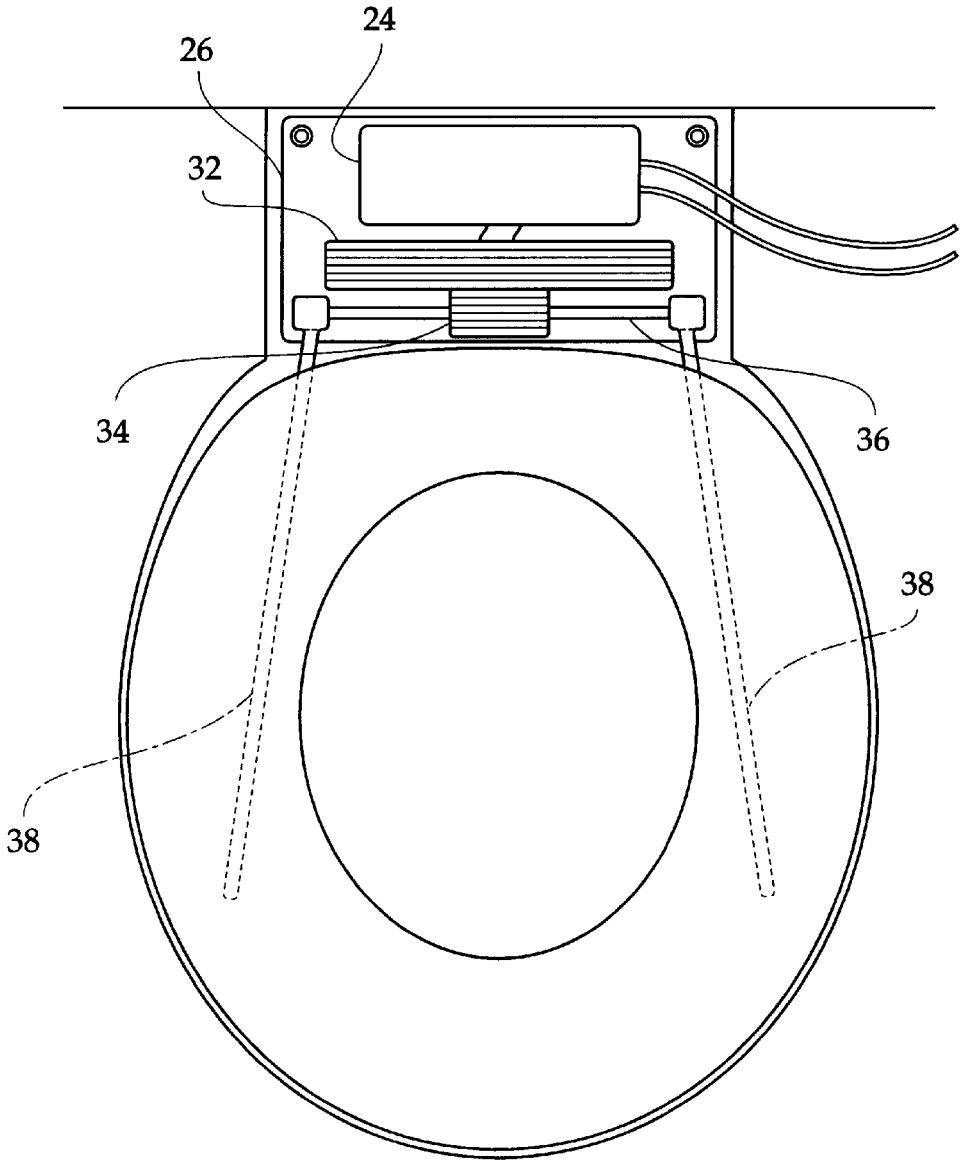
FIG. 3 is a top plan view of the present invention illustrated in cross-section.
Figure 4:
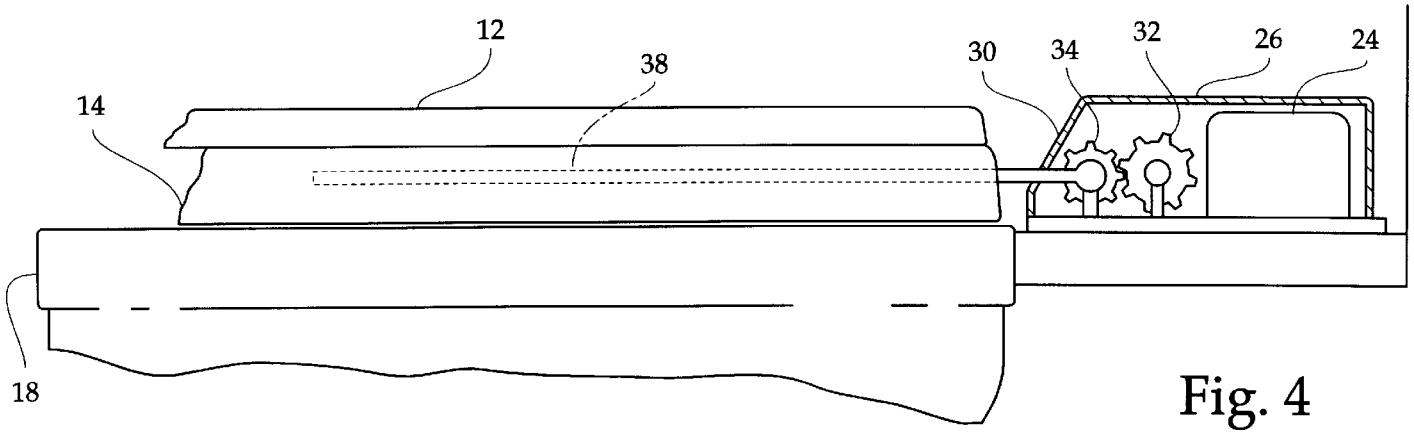
FIG. 4 is a side view of the present invention illustrated with the toilet seat and cover in a lowered position.
Figure 5:
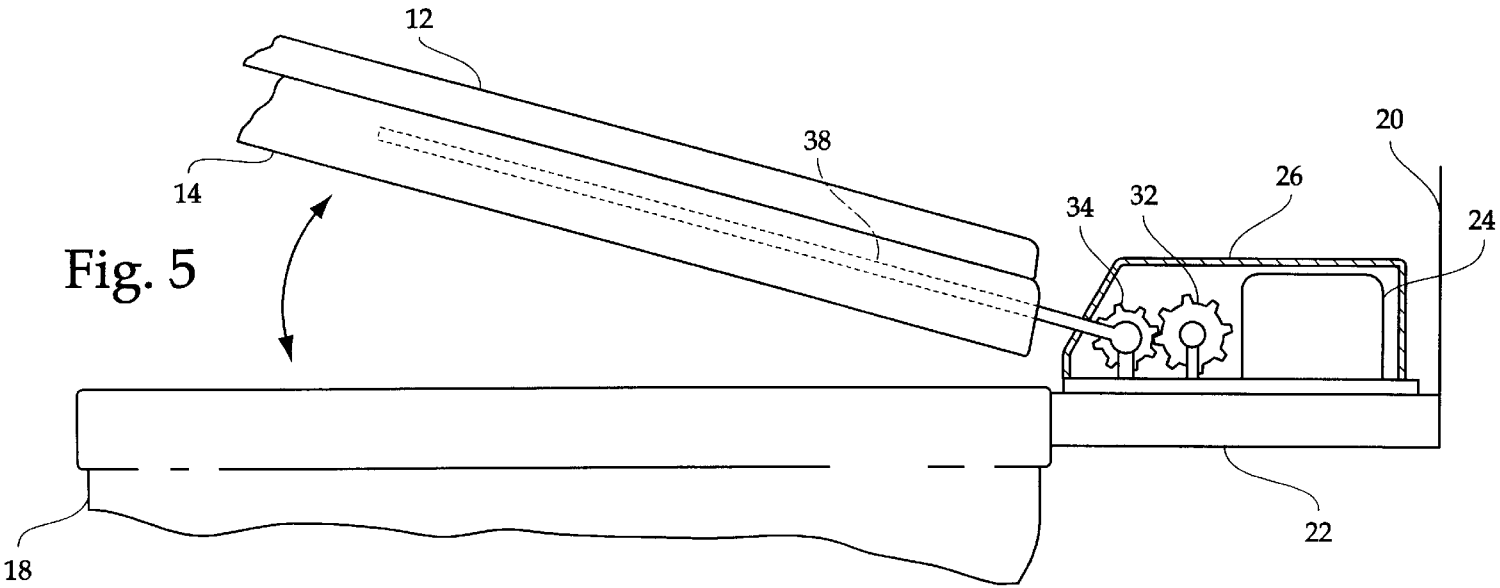
FIG. 5 is a side view of the present invention illustrating the raising of the toilet seat and cover.

With reference now to the drawings, and in particular, to FIGS. 1 through 5 thereof, the preferred embodiment of the new and improved automatic toilet cover and seat lifting and lowering device embodying the principles and concepts of the present invention and generally designated by the reference number 10 will be described.

Specifically, it will be noted in the various figures that the device relates to an automatic toilet cover and seat lifting and lowering device for automatically lifting and lowering a toilet seat and toilet cover without physical assertion. In its broadest context, the device consists of an electrically powered motor, a lifting apparatus, and an activation switch. Such components are individually configured and correlated with respect to each other so as to attain the desired objective.

The present invention is essentially designed for use with a toilet cover 12 and toilet seat 14 that are pivotally coupled with a toilet 16. The toilet is comprised of a bowl portion 18 and a tank portion 20 coupled together at a central flange 22.

The electrically powered motor 24 is secured to the cental flange 22 of the toilet 16. The motor 24 will be powered by a standard power source. The motor 24 is positioned under a protective housing 26. The protective housing 26 has recesses 28 to accommodate the hinged coupling of the toilet seat 14 and toilet cover 12 to the central flange 22. Additionally, the protective housing 26 is provided with a tapered forward edge 30. The motor 24 includes a central gear 32 positioned forwardly thereof.

The lifting apparatus is coupled with the motor 24 and the toilet seat 14 and toilet cover 12. The lifting apparatus includes a gear 34 disposed under the protective housing 26 and positioned forwardly of and engaged to the central gear 32 of the motor 24. The gear 34 has a shaft 36 extending laterally therethrough. The shaft 36 has opposed free ends. The opposed free ends each have an elongated arm 38 extending forwardly therefrom. The elongated arms 38 extend within the toilet seat 14 and the toilet cover 12.

The activation switch 40 is disposed adjacent to the toilet 16 or on the floor for foot operation. The activation switch 40 is in communication with the motor 24. The activation switch 40 has a first position for operating the motor 24 in a raising orientation and a second position for operating the motor 24 in a lowering orientation. The activation switch 40 will allow the user to selectively raise or lower the toilet cover 12 and the toilet seal 14 simultaneously. The present invention could easily be altered to allow for the separate operation of the toilet cover 12 and toilet seat 14.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An automatic toilet cover and seat lifting and lowering device for automatically lifting and lowering a toilet seat and toilet cover without physical assertion, wherein the toilet cover and toilet seat are pivotally coupled with a toilet, the toilet being comprised of a bowl portion and a tank portion coupled together at a central flange, the lifting and lowering device comprising, in combination:

an electrically powered motor secured to the cental flange of the toilet, the motor being positioned under a protective housing, the motor including a central gear positioned forwardly thereof;

a lifting apparatus coupled with the motor and at least one of the toilet seat and toilet cover, the lifting apparatus including a gear disposed under the protective housing and positioned forwardly of and engaged to the central gear of the motor, the gear having a shaft extending laterally therethrough, the shaft having opposed free ends, the opposed free ends each having an elongated arm extending forwardly therefrom, the elongated arms extending within at least one of the toilet seat and the toilet cover; and an activation switch disposed adjacent to the toilet, the activation switch being in communication with the motor, the activation switch having a first position for operating the motor in a raising orientation and a second position for operating the motor in a lowering orientation.

2. An automatic toilet cover and seat lifting and lowering device for automatically lifting and lowering a toilet seat and toilet cover without physical assertion, wherein the toilet cover and toilet seat are pivotally coupled with a toilet, the toilet being comprised of a bowl portion and a tank portion coupled together at a central flange, the lifting and lowering device comprising, in combination:

a motor secured to the cental flange of the toilet, the motor including a central gear positioned forwardly thereof;

a lifting apparatus coupled with at least one of the motor and the toilet seat and toilet cover, the lifting apparatus including a gear positioned forwardly of and engaged to the central gear of the motor, the gear having a shaft extending laterally therethrough, the shaft having opposed free ends, the opposed free ends each having an elongated arm extending forwardly therefrom, the elongated arms extending within at least one of the toilet seat and the toilet cover; and an activation switch disposed adjacent to the toilet, the activation switch being in communication with the motor, the activation switch having a first position for operating the motor in a raising orientation and a second position for operating the motor in a lowering orientation.

* * * * *